US007802322B2

(12) United States Patent
Koch et al.

(10) Patent No.: US 7,802,322 B2
(45) Date of Patent: Sep. 28, 2010

(54) SAFETY SUIT

(75) Inventors: Jochim Koch, Ratzeburg (DE); Kim Sascha Steingrube, Steinhorst (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 0 days.

(21) Appl. No.: 12/390,746

(22) Filed: Feb. 23, 2009

(65) Prior Publication Data

US 2009/0260137 A1 Oct. 22, 2009

(30) Foreign Application Priority Data

Apr. 18, 2008 (DE) ..... 10 2008 019 513

(51) Int. Cl.
*A41D 13/005* (2006.01)
*A41D 27/28* (2006.01)
*A41D 13/00* (2006.01)

(52) U.S. Cl. ..... 2/456; 2/97; 2/250; 2/272; 2/905

(58) Field of Classification Search ..... 2/455, 2/456, 458, 69, 81, 97, 250, 272, 905, DIG. 1
See application file for complete search history.

(56) References Cited

U.S. PATENT DOCUMENTS

| | | | | |
|---|---|---|---|---|
| 3,049,896 | A * | 8/1962 | Webb | 128/201.25 |
| 3,174,300 | A | 3/1965 | Webb | |
| 5,386,823 | A * | 2/1995 | Chen | 128/204.15 |
| 6,125,645 | A * | 10/2000 | Horn | 62/259.3 |
| 6,948,191 | B2 | 9/2005 | Avery et al. | |
| 2005/0197684 | A1 * | 9/2005 | Koch | 607/104 |

FOREIGN PATENT DOCUMENTS

| | | |
|---|---|---|
| DE | 28 46 139 | 4/1980 |
| EP | 1 494 760 B1 | 10/2005 |

* cited by examiner

*Primary Examiner*—Bobby H Muromoto, Jr.
(74) *Attorney, Agent, or Firm*—McGlew & Tuttle, P.C.

(57) ABSTRACT

A safety suit has an interior space that is well air conditioned while the weight to be carried along by the user of the safety suit is reduced to a minimum. A heat exchanger surface (5), which is provided with a porous material (17) towards the outside for evaporating liquid, is provided at the safety suit jacket (3).

20 Claims, 2 Drawing Sheets

SAFETY SUIT

CROSS REFERENCE TO RELATED APPLICATIONS

This application claims the benefit of priority under 35 U.S.C. §119 of German Patent Application DE 10 2008 019 513.8 filed Apr. 18, 2008, the entire contents of which are incorporated herein by reference.

FIELD OF THE INVENTION

The present invention pertains to a safety suit as it is used in the chemical industry or in missions during catastrophes. The safety suit protects the body of the user of the suit together with his respirator from the ambient atmosphere, so that an air volume insulated from the ambient atmosphere is present between the user of the suit and the safety suit.

BACKGROUND OF THE INVENTION

The physiological stress for the user of safety suits is very high because the inside temperature and the humidity in the suit increase very rapidly during physical stress. The high humidity of the air, in particular, causes that the person can no longer sufficiently release his body heat, because the heat is released predominantly by sweating during high physical stress. The mission of rescue teams with safety suits is very limited in time due to this circumstance and the duration of the mission is therefore at most only 10 to 20 minutes. If a long distance is to be covered to the site of the mission, only little time and energy is left for the rescue mission proper and the individual retreat.

Humans are definitely able to perform physical activity over several hours even at ambient temperatures of 42° C. if the humidity of the air is relatively low, i.e., below 30% relative humidity. Even though the body temperature rises somewhat in the process, it does, however, remain at a stable level in this case. The same applies to the heart rate.

The body temperature rises continuously at a markedly reduced air temperature of 32° C. but very high relative humidity of 84% and the test subject will become exhausted very quickly. The circumstance that exhaustion is accelerated by the fact that a respirator is also present on the person's body besides the safety suit is to be taken into consideration in case of persons who use a safety suit.

A safety suit, in which air is fed in from the outside by means of a blower and released from the safety suit via a pressure relief valve is known from EP 1 494 760 B1. Even though a measurable cooling effect arises due to the rinsing with air, the moisture cannot be prevented from accumulating in the interior space of the suit and from condensing on the material of the safety suit. The condensate collects partially on the clothing, which is unpleasant for the user of the suit. In addition, the blower draws in ambient air, which may be contaminated and must be thoroughly filtered. The residual risk that contaminated air can enter the interior space of the safety suit is not accepted by the users.

Cooling with a liquid is also used to cool or regulate the temperature of persons. This is used in space suits, but also in safety chemical suits. However, this principle is limited in its action because it acts directly on the skin via the conductive cooling action. The skin temperature must be kept so cool that no sweating will develop, and it leads as a result to unphysiological or very unpleasant, cold skin temperatures. The cooling source proper is arranged outside the suit. The total cooling energy must be carried along in case of a mobile device, which leads to heavy weights of approx. 12-18 kg additionally and to a correspondingly large volume. Water ice storage units carried along have corresponding net weights of 3.23 kg for the ice plus the own weight of the housing at a hypothetical cooling energy of 1,080 kJoules, which corresponds to a cooling capacity of 800 W over 30 minutes. The handling of the water ice is complicated because the ice must first be prepared and finally removed from the cooling containers and charged into the cooling device. A safety suit with a cooling source appears, for example, from DE 28 46 139 C2.

A safety suit, in which the air in the interior space is circulated by means of a blower and both carbon dioxide and moisture are removed in the process is known from U.S. Pat. No. 3,174,300. The oxygen consumed is replaced. A chamber filled with a refrigerant is used to separate moisture, and the condensate formed is collected in a collection tank. Even though the temperature and the humidity can be readily set in the interior space in the prior-art safety suit, a refrigerant must be carried along and replaced after a certain time of use. The cooling energy available is greatly limited by the weight of the refrigerant carried along.

SUMMARY OF THE INVENTION

The basic object of the present invention is to improve a safety suit such that the weight to be carried along by the user of the suit is reduced to a minimum while air conditioning is good.

According to the invention, a safety suit is provided comprising a safety suit jacket enclosing an interior space, a first blower circulating air in the interior space and a heat exchanger surface at the safety suit jacket for condensing liquid. A porous material is provided for evaporating a liquid on the outside of the safety suit jacket. The porous material is in contact with the heat exchanger surface. A first flow channel encloses the porous material. A second blower is associated with the first flow channel for delivering ambient air over the surface of the porous material. A liquid supply means for supplying cooling liquid for wetting the porous material is provided.

The user of the suit is ventilated by forced ventilation due to the circulating ventilation of the interior space of the safety suit by means of a first blower, and this leads to better evaporation of the moisture on the skin and on the clothing of the user of the suit and hence to a smaller rise in body temperature. The well-being of the user of the suit improves as a result. The condensate in the interior space is separated at the heat exchanger surface and collected in a reservoir. The outside of the heat exchanger surface is provided with a porous material and is designed in the form of a surface evaporator or evaporative cooler to evaporate liquid. The porous material is located in a flow channel, and a second blower delivers ambient air over the surface of the porous material to increase the evaporation capacity. The porous material can be wetted by water carried along during the start-up phase. Feeding of a cooling liquid is provided for this, for example, through a container filled with water on the outside of the safety suit. This container can also be simply refilled with water or another liquid when needed.

In addition, the porous material can be wetted with the condensate collected in the interior space, so that the evaporation capacity of the evaporative cooler is supported with the collected condensate. Sorption materials, with which evaporation on a large surface is possible, such as textile materials, cotton or sintered materials, are suitable for use as porous materials.

It is especially advantageous in the safety suit according to the present invention that, aside from the water reserve, only a small energy reserve must be carried along to operate the two blowers. The weight to be carried along to cool the user of the suit can thus be reduced to a minimum.

The design of the evaporative cooler can be calculated with thermodynamic formulas. It is to be taken into account that the available cooling surface is markedly smaller than the surface of the person, which is 1.8 $m^2$ at an average height. The base of a respirator on the back is 40×60 cm, i.e., 0.24 $m^2$, and is consequently only a fraction of about one-seventh of the human body surface. If an equal cooling effect is to be obtained as on the skin surface, the evaporative action must be brought about by intensified throughput of cooling air. In addition, the cooling surface can be multiplied by arranging in parallel additional cooling surfaces or by a rib design. An evaporative capacity that is equal to that of the user, e.g., 530 W, must be generated by means of the cooling surface. The specific heat of evaporation of water is 2,350 kJoules per kg. This leads to a quantity of sweat or evaporation of at least 0.81 kg per hour. The real quantity of sweat may, however, exceed this value, because the human body is able to produce more sweat than it can evaporate. It is known from the literature that the human body can produce up to 3 L of sweat during the first hour of a mission.

If one assumes that the ambient air has a temperature of 23° C. and a relative humidity of 50%, containing 9 g of water per kg of air, the ambient air can take up a maximum absolute quantity of 18 g of moisture per kg at saturation, i.e., the air can absorb a maximum of 9 g of water per kg until it is fully saturated. A quantity of 830 g to be evaporated per hour must be removed with a cooling air gas flow of 92 kg of air per hour, corresponding to 71 $m^3$ per hour, i.e., 1,180 L of air per minute. This is technically possible with the use of small fans. These fans do not have to overcome a high flow resistance, because they are only to ensure circulation. A commercially available axial fan with an output of 84 $m^3$ per hour has a power consumption of 2.2 W and a size of about 92×92×25 mm. The noise is 32 dBA.

The absolute humidity in the interior space of the safety suit shall be kept as low as possible in order for the evaporation of the user's sweat to be able to function, because the more the humidity rises, the less he is able to release his sweat by evaporation. Without cooling, the user of the suit wets the entire body with sweat, produces drops, which collect in the lower area, primarily in the boots because of the force of gravity. Studies have shown that the air temperature in the suit has risen within 30 minutes from 20° C. to 30° C. and is not yet at equilibrium in uncooled suits. The humidity rises from 40% relative humidity to 90% relative humidity, but this becomes established at a relatively stable value at a relative humidity of about 90%. The body temperature of the user of the suit has increased very greatly within these 30 minutes and the thermal comfort is described as "uncomfortable" to "very uncomfortable" and the user of the suit faces physical exhaustion. A cooling means must ensure for this reason that the humidity of the air is markedly reduced in the interior space. If the relative humidity were reduced from 90% to 50%, the absolute water content in the air will decrease from 27 g to about 13 g per kg of air. This means that the difference in partial pressure is reduced markedly and more liquid can be evaporated.

The evaporative cooling must consequently be able to extract water from the interior space. This is brought about according to the present invention by a porous material on the outside of a heat exchanger surface, with which the inner wall temperature is lowered. The moisture of the interior air can condense at the heat exchanger surface and the relative humidity in the suit can thus be reduced.

The power necessary for cooling is reduced in the evaporative cooler to the drive of the two blowers. A battery for the two blowers would have to have a rated capacity of about 5 Ampere-hours for a mission time of 30 minutes. Commercially available batteries with a rated capacity of about 7 Ampere-hours and a permanent current of 170 mA weigh about 50 g. In addition to the weight of the blower and the power source, only the heat exchanger is needed, which has an estimated weight of about one kg. On the whole, an additional weight of about 2-3 kg arises, which is acceptable for practice.

Provisions are made in an advantageous embodiment of the present invention to transport the condensate on the inside of the heat exchanger surface via small wicks to the outside and to evaporate it there by means of the porous material. The wicks may be elongated or arranged such that they are distributed over a surface in order to release the condensate over a large area to the porous material.

An exemplary embodiment of the present invention is shown in the figure and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
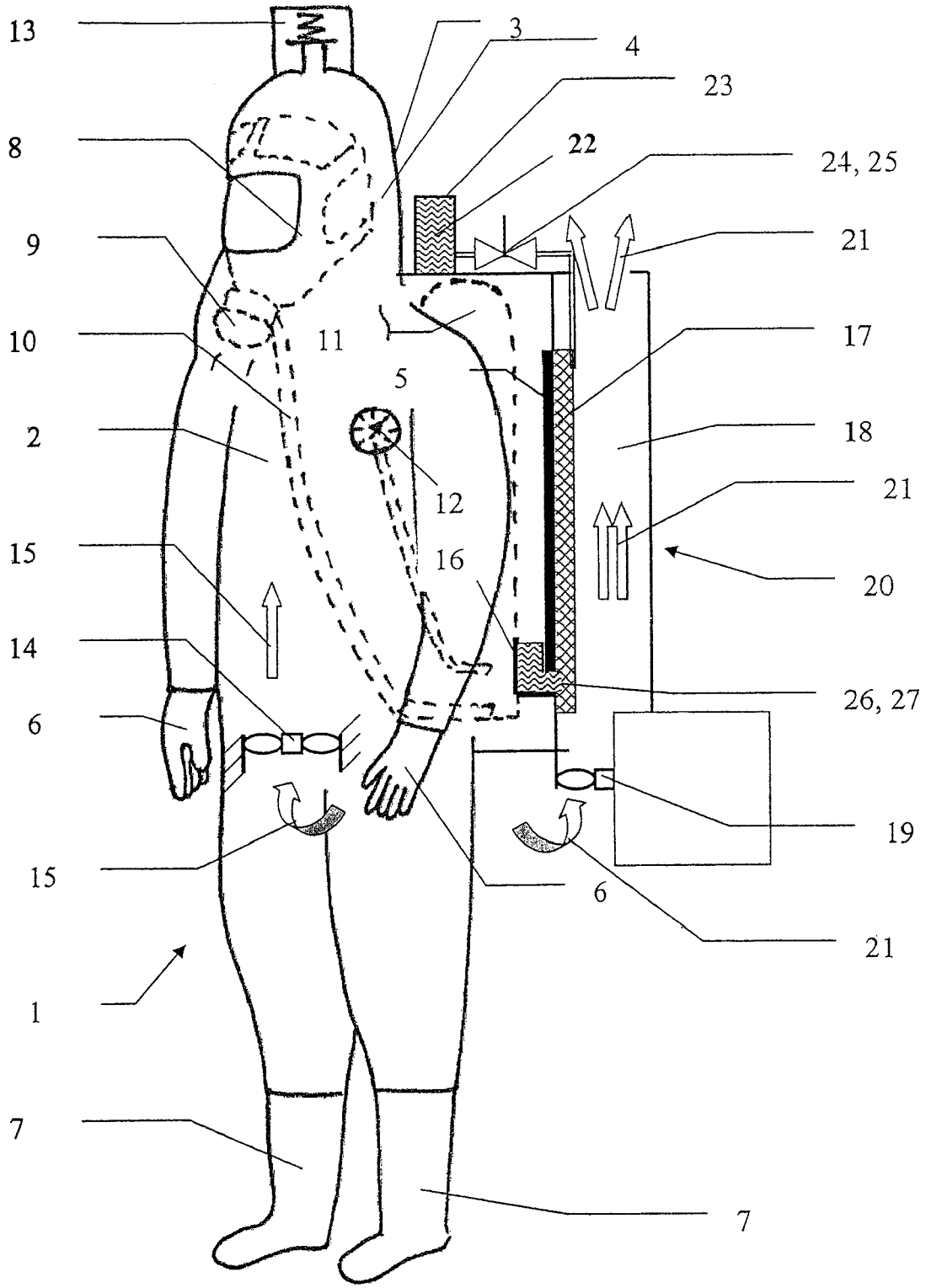
FIG. 1 is a schematic view showing a safety suit with an evaporative cooler.

Referring to the drawings in particular, FIG. 1 schematically shows a safety suit 1, which completely surrounds a user 2 of the suit. The safety suit 1 comprises a safety suit jacket 3, which encloses an interior space 4 with a heat exchanger surface 5 on the rear side of the suit and with attached gloves 6 at the hands and boots 7 at the feet of the user 2 of the suit. The user 2 of the suit receives the breathing air via a full mask 8 with a full mask 8 with a demand valve 9, a pressurized gas tube 10 and a pressurized gas container 11, which is fastened to the back. The current gas pressure of the pressurized gas container 11 is displayed via a pressure gage 12. The gas breathed out by the user 2 of the suit escapes into the interior space 4 and is released into the environment via a pressure relief valve 13.

A first blower 14 for circulating the air of the interior space is arranged in the interior space 4 of the safety suit jacket 3, the air of the interior space being circulated in a closed circuit and led continuously past the heat exchanger surface 5 along arrows 15. Condensed liquid is collected in a reservoir 16 on the underside of the heat exchanger surface 5. The heat exchanger surface 5 is provided with a porous material 17 for evaporating liquid on the outside towards the environment.

The porous material is accommodated in a flow channel 18, and a second blower 19 delivers ambient air over the surface of the porous material 17 along arrows 21.

The heat exchanger surface 5 with the porous material 17 arranged in the flow channel 18 and the second blower 19 together form the evaporative cooler 20 of the safety suit 1.

A container 23 filled with water 22, which container has a discharge line 25 that can be shut off with a valve 24, is arranged on the outside of the safety suit jacket 3.

The porous material 17 can be wetted with water 22 via the discharge line 25. Reservoir 16 on the underside of the heat exchanger surface 5 is in connection via a liquid channel 26 with the porous material 17 in such a way that collected condensate 27 is taken up and evaporated by the porous material 17. The cooling capacity of the evaporative cooler 20 may also be generated by the quantity of evaporated condensate alone in case of sufficient condensate formation.

Figure 2:
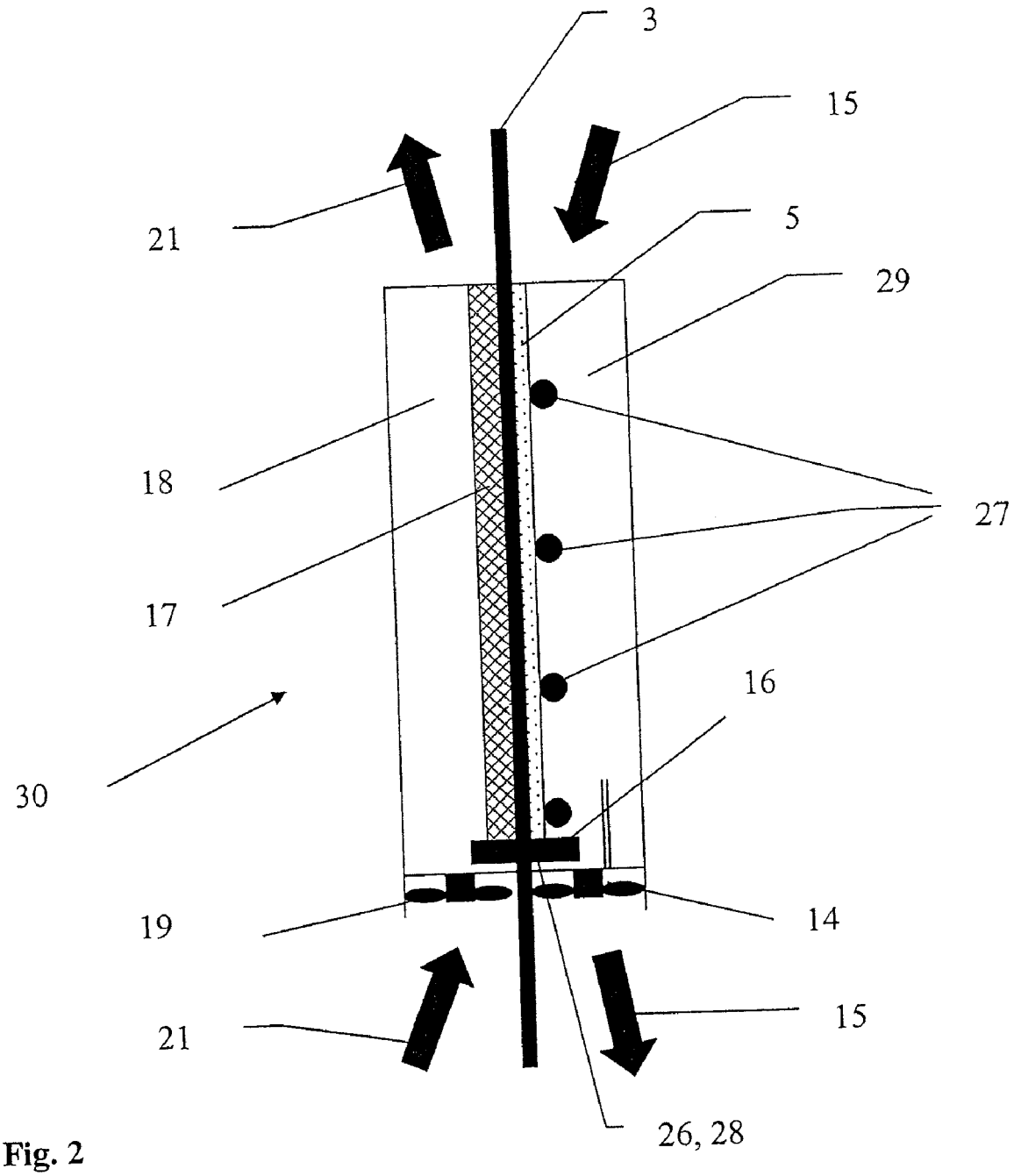
FIG. 2 is a schematic sectional view showing a detail of the evaporative cooler according to FIG. 1.

FIG. 2 illustrates an alternative embodiment of an evaporative cooler 30, in which the liquid channel 26 between reservoir 16 and the porous material 17 is provided with individual wicks 28. The wicks 28 transport the condensate 27 from the reservoir 16 to the porous material 17, where it evaporates. Compared to the evaporative cooler 20 corresponding to FIG. 1, the first blower 14 is arranged in the alternative evaporative cooler 30 according to FIG. 2 directly at a second flow channel 29 of the evaporative cooler 30. Identical components are designated by the same reference numbers as in FIG. 1.

While specific embodiments of the invention have been shown and described in detail to illustrate the application of the principles of the invention, it will be understood that the invention may be embodied otherwise without departing from such principles.

LIST OF REFERENCE NUMBERS

1 Safety suit
2 User of suit
3 Safety suit jacket
4 Interior space
5 Heat exchanger surface
6 Glove
7 Boot
8 Full mask
9 Demand valve
10 Pressurized gas tube
11 Pressurized gas container
12 Pressure gage
13 Pressure relief valve
14 First blower
15 Arrow
16 Reservoir
17 Porous material
18 First flow channel
19 Second blower
20 Evaporative cooler
21 Arrow
22 Water
23 Container
24 Valve
25 Discharge line
26 Liquid channel
27 Condensate
28 Wick
29 Second flow channel
30 Evaporative cooler

What is claimed is:

1. A safety suit comprising:
a safety suit jacket enclosing an interior space;
a first blower circulating air in said interior space;
a heat exchanger surface at said safety suit jacket for condensing liquid carried by said first blower;
a porous material for evaporating a liquid, said porous material being provided on the outside of the safety suit jacket, said porous material being in contact with said heat exchanger surface;
a flow channel enclosing the porous material;
a second blower associated with said first flow channel for delivering ambient air over the surface of the porous material; and
a liquid supply means for supplying cooling liquid for wetting the porous material to form an active cooling structure on one side of said heat exchanger.

2. A safety suit in accordance with claim 1, wherein the supply means for cooling liquid comprises a water container arranged on the outside of the safety suit.

3. A safety suit in accordance with claim 1, wherein the supply means for cooling liquid is a reservoir, which receives the condensate of the heat exchanger surface and can be brought into flow connection with the porous material.

4. A safety suit in accordance with claim 1, wherein the porous material consists of a textile nonwoven, cotton or sintered material.

5. A safety suit in accordance with claim 3, further comprising a reservoir connected to the porous material via a wick.

6. A safety suit comprising:
a safety suit jacket enclosing an interior space;
a heat exchanger with a heat exchanger surface for condensing liquid;
a closed circulation circuit with a first blower circulating air in said interior space and leading circulating air over said heat exchanger;
a porous material for evaporating a liquid, said porous material being provided outside of the safety suit jacket, said porous material being in contact with said heat exchanger surface and receiving condensed liquid from said circulating air via said first blower;
a flow channel enclosing the porous material;
a second blower associated with said first flow channel for delivering ambient air over the surface of the porous material; and
a liquid supply means for supplying cooling liquid for wetting the porous material to form an active cooling structure on one side of said heat exchanger.

7. A safety suit in accordance with claim 6, wherein the supply means for cooling liquid comprises a water container arranged on the outside of the safety suit.

8. A safety suit in accordance with claim 6, wherein the supply means for cooling liquid is a reservoir, which receives the condensate of the heat exchanger surface and can be brought into flow connection with the porous material.

9. A safety suit in accordance with claim 6, wherein the porous material consists of a textile nonwoven, cotton or sintered material.

10. A safety suit in accordance with claim 8, wherein said liquid supply means includes a reservoir connected to the porous material via a wick.

11. A safety suit comprising:
a safety suit jacket enclosing an interior space;
a heat exchanger with a heat exchanger surface for condensing liquid;
a closed circulation circuit with a first blower circulating air in said interior space such that said circulated air carries moisture and/or water vapor from a surface of a user's skin to form an air moisture and/or water vapor mixture, said first blower circulating said air moisture and/or water vapor mixture over said heat exchanger, wherein said heat exchanger separates said moisture and/or water vapor from said air mixture to form condensed liquid;

a porous material for evaporating said condensed liquid, said porous material being provided outside of the safety suit jacket, said porous material being in contact with said heat exchanger surface, said porous material absorbing said condensed liquid;

a flow channel enclosing the porous material;

a second blower associated with said first flow channel, said second blower moving ambient air from a position outside said safety suit through said flow channel to another position outside said safety suit, wherein said ambient air passes over the surface of the porous material such that said ambient air carries said condensed liquid in said porous material to said another position outside said safety suit; and a liquid supply means for supplying cooling liquid for wetting the porous material to form an active cooling structure on one side of said heat exchanger.

12. A safety suit in accordance with claim 11, wherein the supply means for cooling liquid comprises a water container arranged on the outside of the safety suit.

13. A safety suit in accordance with claim 11, wherein the supply means for cooling liquid is a reservoir, which receives the condensate of the heat exchanger surface and can be brought into flow connection with the porous material.

14. A safety suit in accordance with claim 11, wherein the porous material consists of a textile nonwoven, cotton or sintered material.

15. A safety suit in accordance with claim 13, wherein said liquid supply means includes a reservoir connected to the porous material via a wick.

16. A safety suit in accordance with claim 1, wherein said circulated air carries moisture and/or water vapor from a skin surface of a user to form an air moisture and/or water vapor mixture, said air moisture and/or water vapor mixture passing over said heat exchanger via said first blower, wherein said heat exchanger removes aid moisture and/or water vapor from said air moisture and/or water vapor mixture to form condensed liquid, said porous material absorbing said condensed liquid, wherein said second blower provides a flow of said ambient air over said porous material such that said flow of ambient air carries said condensed liquid to a position outside of said safety suit.

17. A safety suit in accordance with claim 16, wherein said first blower circulates air along the surface of the user's skin to said heat exchanger surface to define a closed circuit circulation flow path, wherein the surface of the user's skin is located at a spaced location from an interior surface of said safety suit via said closed circuit circulation flow path, said second blower drawing ambient air from another position outside said safety suit through said flow channel to said position outside of said safety suit to define an open circuit circulation flow path, said flow of said ambient air being substantially parallel to said heat exchanger surface and said porous material.

18. A safety suit in accordance with claim 6, wherein said circulated air carries moisture and/or water vapor from a skin surface of a user to form an air moisture and/or water vapor mixture, said air moisture and/or water vapor mixture passing over said heat exchanger via said first blower, wherein said heat exchanger removes said moisture and/or water vapor from said air moisture and/or water vapor mixture to form condensed liquid, said porous material absorbing said condensed liquid, wherein said second blower provides a flow of ambient air over said porous material such that said flow of ambient air carries said condensed liquid to a position outside of said safety suit.

19. A safety suit in accordance with claim 18, wherein said first blower circulates air along the surface of the user's skin to said heat exchanger surface to define a closed circuit circulation path, wherein the surface of the user's skin is located at a spaced location from an interior surface of said safety suit via said closed circuit circulation flow path, said second blower drawing ambient air from another position outside said safety suit through said flow channel to said position outside of said safety suit to define an open circuit circulation path, said flow of said ambient air being substantially parallel to said heat exchanger surface and said porous material.

20. A safety suit in accordance with claim 11, wherein said first blower circulates air along the surface of the user's skin to said heat exchanger surface to define a closed circuit circulation path, wherein the surface of the user's skin is located at a spaced location from an interior surface of said safety suit via said closed circuit circulation flow path, said second blower drawing ambient air from another position outside said safety suit through said flow channel to said position outside of said safety suit to define an open circuit circulation path, said flow of said ambient air being substantially parallel to said heat exchanger surface and said porous material.

* * * * *